US011100880B2

(12) United States Patent
Kuo et al.

(10) Patent No.: US 11,100,880 B2
(45) Date of Patent: Aug. 24, 2021

(54) PIXEL ARRAY WITH GATE DRIVER AND MATRIX SENSOR ARRAY

(71) Applicant: Industrial Technology Research Institute, Hsinchu (TW)

(72) Inventors: Wen-Yu Kuo, Hsinchu County (TW); Wen-Ya Chao, Hsinchu (TW); Ying-Ting Liou, Hsinchu County (TW); Wei-Chung Chen, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 16/850,009

(22) Filed: Apr. 16, 2020

(65) Prior Publication Data

US 2021/0201837 A1 Jul. 1, 2021

(30) Foreign Application Priority Data

Dec. 31, 2019 (TW) ..... 108148657

(51) Int. Cl.
*G09G 3/36* (2006.01)

(52) U.S. Cl.
CPC ... *G09G 3/3677* (2013.01); *G09G 2300/0857* (2013.01); *G09G 2310/0286* (2013.01)

(58) Field of Classification Search
CPC ..... G09G 3/3677; G09G 2300/0857
See application file for complete search history.

(56) References Cited

U.S. PATENT DOCUMENTS

| | | | | |
|---|---|---|---|---|
| 9,685,131 | B2 | 6/2017 | Tanaka et al. | |
| 2017/0031477 | A1* | 2/2017 | Jamshidi Roudbari | G09G 3/3266 |
| 2017/0287381 | A1* | 10/2017 | Park | G09G 3/3677 |
| 2018/0331125 | A1 | 11/2018 | Wang et al. | |
| 2019/0164478 | A1 | 5/2019 | Kim et al. | |

(Continued)

FOREIGN PATENT DOCUMENTS

| | | |
|---|---|---|
| CN | 106935168 | 7/2017 |
| CN | 104849928 | 4/2019 |
| TW | 201035938 | 10/2010 |

(Continued)

OTHER PUBLICATIONS

"Office Action of Taiwan Counterpart Application", dated Sep. 18, 2020, p. 1-p. 7.

*Primary Examiner* — Sahlu Okebato
(74) *Attorney, Agent, or Firm* — JCIPRNET

(57) ABSTRACT

A pixel array with a gate driver and a matrix sensor array are provided. The pixel array includes at least one pixel unit and a gate driver. The pixel unit includes a pixel circuit and an open area. The pixel circuit includes a thin film transistor (TFT) and a physical quantity conversion device. The TFT includes gate terminal, source terminal, and drain terminals. The source terminal is coupled to a corresponding data line. The physical quantity conversion device is coupled to the drain terminal of the TFT. The gate driver is disposed in a corresponding pixel unit and a scan line outputted by the gate driver is coupled to the gate terminal in the corresponding pixel unit. The gate driver is disposed adjacent to one of the at least one pixel unit. The gate driver is controlled by a gate control signal to drive the at least one pixel unit.

14 Claims, 16 Drawing Sheets

(56) References Cited

U.S. PATENT DOCUMENTS

2020/0033994 A1* 1/2020 Shin ..... H01L 27/1443

FOREIGN PATENT DOCUMENTS

| | | |
|---|---|---|
| TW | I475536 | 3/2015 |
| TW | I517135 | 1/2016 |
| TW | I522978 | 2/2016 |
| TW | I582739 | 5/2017 |
| TW | I662326 | 6/2019 |

* cited by examiner

PIXEL ARRAY WITH GATE DRIVER AND MATRIX SENSOR ARRAY

CROSS-REFERENCE TO RELATED APPLICATION

This application claims the priority benefit of Taiwan application serial no. 108148657, filed on Dec. 31, 2019. The entirety of the above-mentioned patent application is hereby incorporated by reference herein.

BACKGROUND

Technical Field

The disclosure relates to a matrix circuit element layout technology, and more particularly to a pixel array with a gate driver and a matrix sensor array.

Description of Related Art

Now that consumers are increasingly demanding in terms of the view range of displays, many manufacturers wish to design electronic device displays with narrow fames or even no frame. Although the driving elements required by the display may be configured around the view area of the display panel, these driving elements still occupy some area (e.g., a width of about 1 to 2 mm) of the frame around the display. As a result, a frameless design cannot be implemented.

In addition, multiple driving elements in the display are being controlled due to being connected in series. In other words, the next-level driving element will not be triggered until the current-level driving element is triggered/enabled. Although the quantity of control signals may be saved, if a driving element of a certain level malfunctions and signals are unable to be transmitted to the next-level driving element, a large amount of pixel units may not operate normally.

How to configure the driving elements in the limited space of the display to achieve a frameless design is the direction for finding a solution sought by current manufacturers. On the other hand, it is desired for the matrix sensor to compress the circuit layout thereof as much as possible, so there are similar requirements.

SUMMARY

A pixel array with a gate driver according to an embodiment of the disclosure includes at least one pixel unit and a gate driver. The pixel unit includes a pixel circuit and an open area. The pixel circuit includes a thin film transistor and a physical quantity conversion device. The thin film transistor includes a gate terminal, a source terminal, and a drain terminal. The source terminal is coupled to a corresponding one of a plurality of data lines. The physical quantity conversion device is coupled to the drain terminal of the thin film transistor. The gate driver is disposed in the corresponding pixel unit and a scan line outputted by the gate driver is coupled to the gate terminal in the corresponding pixel unit. The gate driver is disposed adjacent to one of the at least one pixel unit. The gate driver is controlled by a gate control signal to drive the corresponding pixel unit.

A matrix sensor array with a gate driver according to an embodiment of the disclosure includes at least one sensor and a gate driver. The sensor includes a sensing circuit and an open area. The sensing circuit includes a thin film transistor and a physical quantity conversion device. The thin film transistor includes a gate terminal, a source terminal, and a drain terminal. The source terminal is coupled to a corresponding one of a plurality of data lines. The physical quantity conversion device is coupled to the drain terminal of the thin film transistor. The gate driver is disposed in the corresponding sensor and a scan line outputted by the gate driver is coupled to the gate terminal of the corresponding sensor. The gate driver is disposed adjacent to one of the at least one sensor. The gate driver is controlled by a gate control signal to drive the corresponding sensor.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

According to an embodiment of the disclosure, a gate driver in a display is embedded in a pixel array of a display panel, and the gate driver and a pixel circuit are configured with a transparent material, thereby implementing a frameless design. The embodiment is also designed such that a single gate driver drives one or more pixel units at the same time, thereby improving the open ratio on pixel circuits and the light transmittance of the display. In the embodiment, the gate driver and the corresponding pixel unit are also modularized and the pixel modules are used to design the corresponding display panel. On the other hand, the pixel array in an embodiment of the disclosure may use two or more sets of gate drivers to drive one or more pixel units at the same time. As such, after the display panel is manufactured, for example, laser repair technology may be used to make up for any error (e.g., lines which cannot be properly coupled) of the semiconductor process or the corresponding technology which causes the gate driver to be erroneous, thereby improving the yield without having to dispose the entire display panel. Furthermore, in addition to the pixel array of the display panel, the embodiments of the disclosure may also be applied to a matrix sensor array, thereby reducing the circuit layout area of the matrix sensor array and improving the sensor density per unit area. Various embodiments consistent with the disclosure are exemplified below.

Figure 1:
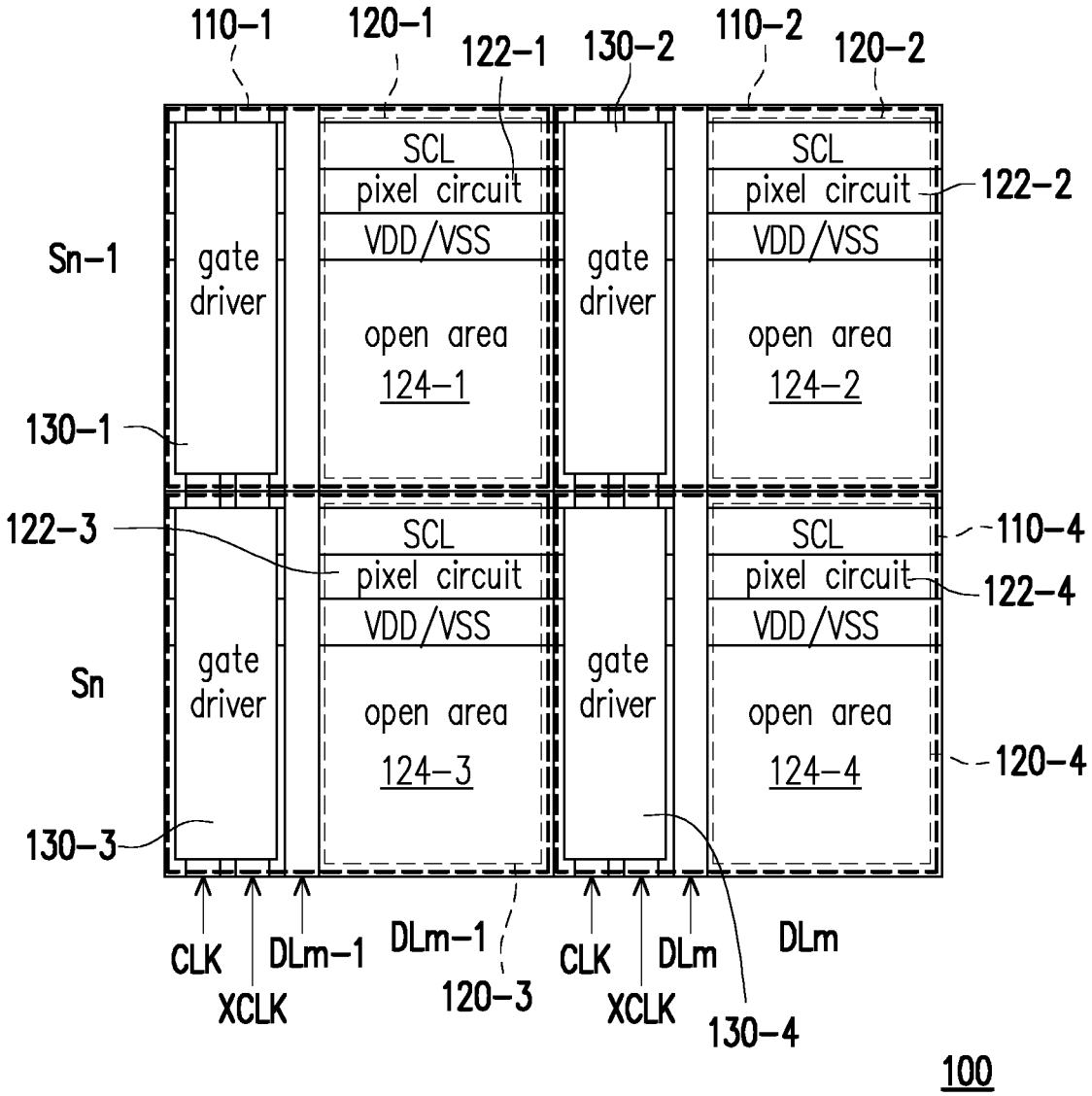
FIG. 1 is a schematic view of a pixel array with a gate driver according to a first embodiment of the disclosure.
Figure 2:
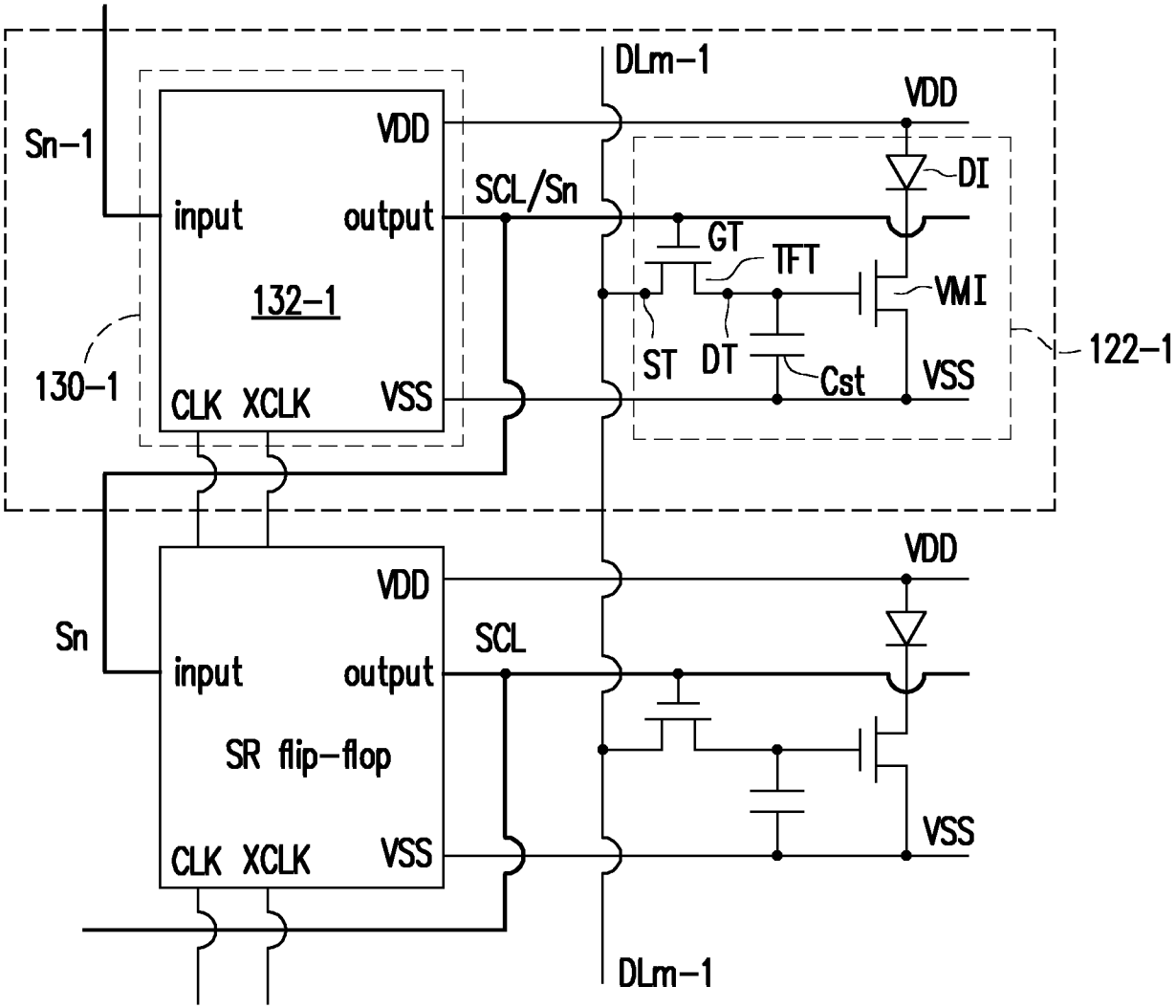
FIG. 2 is a circuit diagram of a pixel array module in FIG. 1 according to the first embodiment of the disclosure.

FIG. 1 is a schematic view of a pixel array 100 with a gate driver according to a first embodiment of the disclosure. FIG. 2 is a circuit diagram of a pixel array module 110-1 in FIG. 1 according to the first embodiment of the disclosure. FIG. 1 is exemplified using a display panel. The display panel is a combination of a plurality of modularized pixel array modules (e.g., pixel array modules 110-1 to 110-4 in FIG. 1). In other words, the display panel is a pixel array 100 with a gate driver in the embodiment. Persons applying the embodiment may use units of the pixel array module to assemble the display panel.

FIG. 1 illustrates four pixel array modules 110-1 to 110-4 as examples. Each pixel array module 110-1 to 110-4 includes at least one pixel unit 120-1 to 120-4 and a gate driver 130-1 to 130-4. Each pixel unit 120-1 to 120-4 includes a pixel circuit 122-1 to 122-4 and an open area 124-1 to 124-4. The pixel circuit 122-1 to 122-4 includes a thin film transistor and a physical quantity conversion device (e.g., a photoelectric conversion device or other devices capable of converting heat, mechanical force, and power). The thin film transistor in the embodiment may be implemented by a transistor formed by indium gallium zinc oxide (IGZO), amorphous silicon (a-Si), low temperature polysilicon (LTPS), an organic field-effect transistor (OFET), a type of transistor formed by semiconductor process, or a combination thereof. The physical quantity conversion device of the embodiment may be a photoelectric conversion device implemented by a liquid crystal display (LCD) technology, a light emitting diode (LED) display technology, an organic light emitting diode (OLED) display technology, an electrophoretic display (EPD) technology, a photo diode sensing element, etc. In other embodiments consistent with the disclosure, the pixel unit may be replaced by a sensor and the physical quantity conversion device may also be replaced with a different type of sensing element, such as an electrothermal conversion device (e.g., a pixel heater) or other devices capable of converting mechanical force and power, such as a pressure sensor, thereby implementing a matrix sensor array. The reference numerals Sn−1 and Sn illustrated in the left area of FIG. 1 are used to indicate gate control signals Sn−1 and Sn (that is, signals on a scan line) outputted by gate drivers (e.g., gate drivers 130-1 and 130-2) corresponding to the row, where n is a positive integer. The reference numerals DLm and DLm+1 illustrated in the lower area of FIG. 1 are used to indicate data lines DLm−1 and DLm coupled to a pixel circuit (e.g., pixel circuit 122-1 and 122-2) corresponding to the column, where m is a positive integer. In other words, the display panel 100 includes a plurality of scan lines and a plurality of data lines.

The physical quantity conversion device of the embodiment is implemented by, for example, a light emitting diode display panel or an organic light emitting diode display panel. In addition to the aforementioned display panel types, persons applying the embodiment may take into consideration all display panels provided by an active matrix display technology, such as a liquid crystal display panel, an electronic paper display panel, etc. In other words, the display panel of the embodiment is exemplified using a liquid crystal display panel. The open areas 124-1 to 124-4 allow light generated by the backlight module of the display to pass through the physical quantity conversion device, so as to control the brightness of the light. On the other hand, the pixel circuits 122-1 to 122-4 and the gate drivers 130-1 to 130-4 of the embodiment may be routed by a transparent material, thereby implementing a frameless design.

The gate driver 130-1 to 130-4 is disposed in the corresponding pixel unit 120-1 to 120-4. The scan line outputted by the gate driver 130-1 to 130-4 is coupled to the gate terminal of the thin film transistor in the corresponding pixel unit 120-1 to 120-4. The gate driver 130-1 to 130-4 is miniaturized to be configured in the adjacent pixel unit 120-1 to 120-4. If there are a plurality of corresponding pixel units in each pixel array module 110-1 to 110-4, the gate driver 130-1 to 130-4 may be configured in one pixel unit in the plurality of pixel units. The term "miniaturized" as described in the embodiment is to minimize the circuit layout of the gate driver and to design the gate driver to be next to one or more pixel units using a transparent material, thereby implementing a frameless design of the display panel 100. In detail, the embodiment is designed to allow the connection spacing between the plurality of transistors in the gate drivers 130-1 to 130-4 to be smaller than twice the length of the layout range of the pixel units 120-1 to 120-41. In addition, the layout area of the transistors in the gate drivers 130-1 to 130-4 is smaller than the layout area of the pixel units 120-1 to 120-4. Persons applying the disclosure should understand the meaning of "miniaturized" and minimize the circuit layout of the gate drivers 130-1 to 130-4 as much as possible, and configure the gate drivers 130-1 to 130-4 in the adjacent pixel units 120-1 to 120-4.

The quantity of the gate driver 130-1 to 130-4 in each pixel array module 110-1 to 110-4 may be adjusted as required. In the first embodiment, each pixel array module 110-1 to 110-4 has a pixel unit 120-1 to 120-4 and a gate driver 130-1 to 130-4. The gate driver 130-1 to 130-4 in each pixel array module 110-1 to 110-4 is controlled by the gate control signal (e.g., the gate control signal Sn−1 and Sn in FIG. 1) and respectively drives the corresponding pixel unit 120-1 to 120-4 located in the same pixel array module 110-1 to 110-4 according to the time sequence and different column/row directions. In other following embodiments consistent with the disclosure, a pixel array module including one or more pixel units combined with one or more gate drivers will also be exemplified.

In FIG. 2, the pixel array module 110-1 is taken as an example and the pixel circuit 122-1 and the gate driver 130-1 in the pixel array module 110-1 are illustrated. The gate driver 130-1 includes an SR flip-flop 132-1. The SR flip-flop 132-1 includes an input terminal input, an output terminal output, a time input terminal CLK, a backward time input terminal XCLK, a ground voltage terminal VSS, and a system voltage terminal VDD. The input terminal input of the SR flip-flop 132-1 is used to receive the scan line Sn−1 outputted by the previous-level gate driver. The output terminal output of the SR flip-flop 132-1 is used to generate and output the gate control signal Sn (the embodiment also refers to the scan line SCL as the gate control signal Sn).

The pixel circuit 122-1 may include a thin film transistor TFT and a physical quantity conversion device (e.g., a single liquid crystal cell (LC cell) on a liquid crystal display panel or a light emitting diode on a light emitting diode display panel), that is, the embodiment uses 1T1C to make up the pixel circuit 122-1. Persons applying the embodiment may also implement using other types of pixel circuits, such as 2T1C, 4T1C, 6T1C, etc. The thin film transistor TFT includes a gate terminal GT, a source terminal ST, and a drain terminal DT. The source terminal ST is coupled to the corresponding data line DLm−1. The scan line SCL/Sn outputted by the gate driver 130-1 is coupled to the gate terminal GT of the thin film transistor TFT in the corresponding pixel unit 120-1, so as to control whether the source terminal ST and the drain terminal DT of the thin film transistor TFT are turned on or off. When the source terminal ST and the drain terminal DT of the thin film transistor TFT are turned on, the signal on the data line DLm−1 will be guided to the physical quantity conversion device, thereby controlling the brightness of the open area.

The pixel circuit 122-1 of the embodiment may further include a voltage stabilizing element. The voltage stabilizing element includes, for example, a diode D1 and a voltage stabilizing transistor VM1. The diode D1 is used to provide the voltage drop of the system voltage terminal VDD to the first terminal of the voltage stabilizing transistor VM1. The control terminal of the voltage stabilizing transistor VM1 is coupled to the drain terminal DT of the thin film transistor TFT and the physical quantity conversion device (e.g., a photoelectric conversion device). The voltage stabilizing transistor VM1 is used to provide the voltage drop between the drain terminal DT of the thin film transistor TFT and the ground voltage terminal VSS. Persons applying the embodiment may design the voltage stabilizing element in the pixel circuit 122-1 as required.

Figure 3:
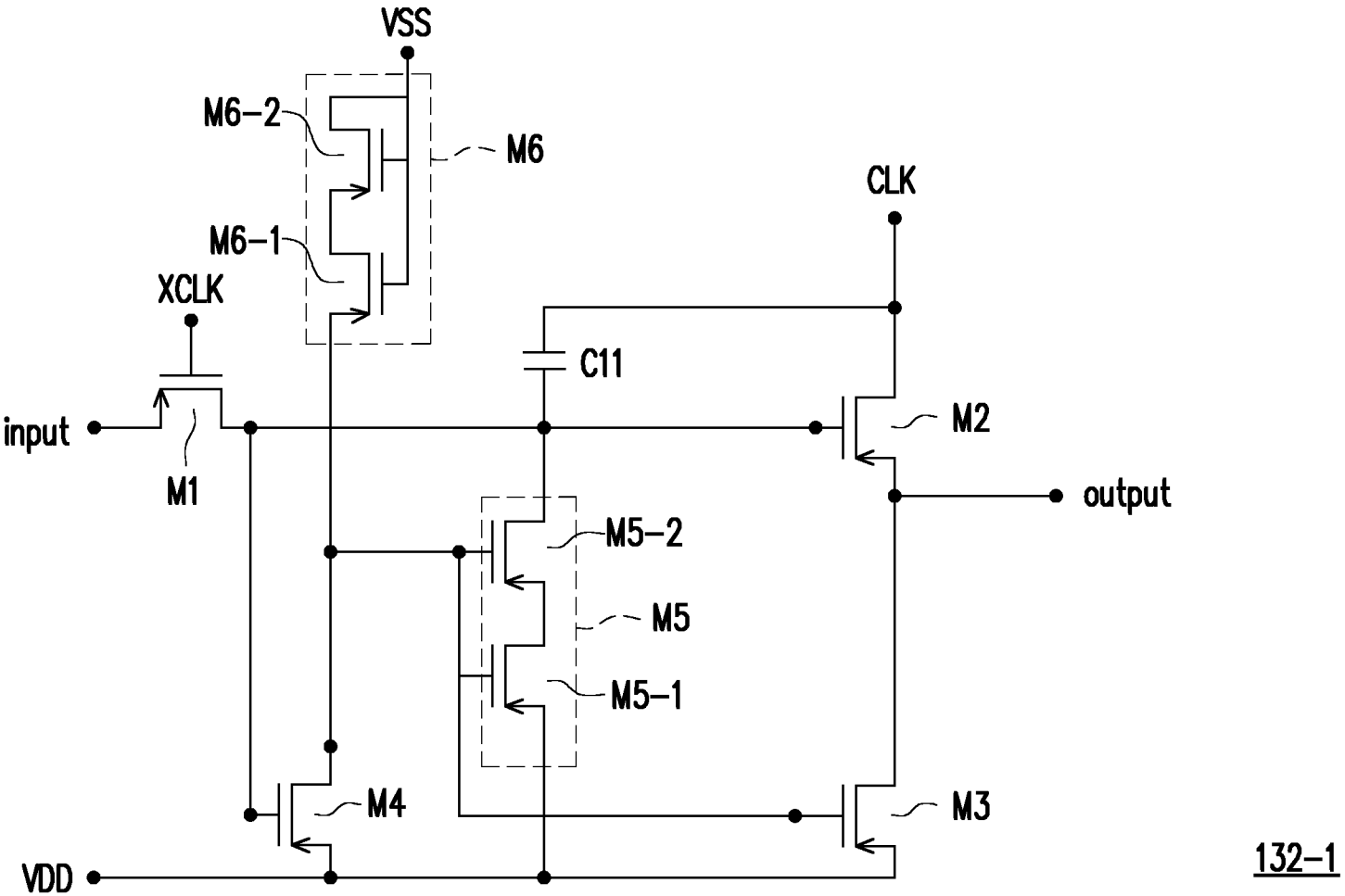
FIG. 3 is a circuit diagram of an SR flip-flop according to an embodiment of the disclosure.

FIG. 3 is a circuit diagram of an SR flip-flop 132-1 according to an embodiment of the disclosure. The embodiment uses the circuit diagram of FIG. 3 as an example of the SR flip-flop 132-1. Persons applying the embodiment may adjust the circuit structure, the transistor quantity, and the aspect ratio of the transistor in the SR flip-flop 132-1 as required, which are not limited to FIG. 3. The SR flip-flop 132-1 may include, for example, first to sixth transistors M1 to M6. A first terminal (source terminal) of the first transistor M1 is coupled to an input terminal input of the SR flip-flop 132-1 to receive a gate control signal Sn−1 outputted by the previous-level gate driver. A control terminal (gate terminal) of the first transistor M1 is coupled to the backward time input terminal XCLK to receive the backward clock signal. A control terminal (gate terminal) of the second transistor M2 is coupled to a second terminal (drain terminal) of the first transistor M1 and a second terminal (drain terminal) of the second transistor M2 is coupled to the time input terminal CLK to receive the clock signal. A first terminal (source terminal) of the third transistor M3 is coupled to the system voltage terminal VDD and a second terminal (drain terminal) of the third transistor M3 is coupled to the first terminal (source terminal) of the second transistor M2. A control terminal (gate terminal) of the fourth transistor M4 is coupled to the second terminal (drain terminal) of the first transistor M1 and a first terminal (source terminal) of the fourth transistor M4 is coupled to the system voltage terminal VDD. A control terminal (gate terminal) of the fifth transistor M5 is coupled to the control terminal (gate terminal) of the third transistor M3 and a second terminal (drain terminal) of the fourth transistor M4. A first terminal (source terminal) of the fifth transistor M5 is coupled to the system voltage terminal VDD and a second terminal (drain terminal) of the fifth transistor M5 is coupled to the second terminal (drain terminal) of the first transistor M1 and the control terminal (gate terminal) of the second transistor M2. A control terminal (gate terminal) of the sixth transistor M6 and a second terminal (drain terminal) thereof are coupled to the ground voltage terminal VSS and a first terminal (source terminal) of the sixth transistor M6 is coupled to the second terminal (drain terminal) of the fourth transistor M4. In addition, the fifth transistor M5 in the embodiment is formed by connecting two transistors M5-1 and M5-2 in series, that is, the drain terminal of the transistor M5-1 is coupled to a source terminal of the transistor M5-2. The sixth transistor M6 in the embodiment is also formed by connecting two transistors M6-1 and M6-2 in series, that is, the drain terminal of the transistor M6-1 is coupled to a source terminal of the transistor M6-2.

For the size of each transistor, for example, the first transistor M1 in the embodiment is implemented by a transistor with a length and a width of 10 μm; the second transistor M2 and the third transistor M3 are implemented by a transistor with a length of 8 μm and a width of 4 μm; the fourth transistor M4 is implemented by a transistor with a length and a width of 4 μm; the transistors M5-1 and M5-2 in the fifth transistor M5 are implemented by a transistor with a length of 5 μm and a width of 4 μm; the transistors M6-1 and M6-2 in the sixth transistor M6 are implemented by a transistor with a length and a width of 4 μm. The embodiment uses the above sizes of the transistors in the SR flip-flop 132-1 to miniaturize the gate driver. Here, data such as the circuit structure and the length and width of the transistors for implementing the SR flip-flop are provided. Persons applying the embodiment may adjust the circuit structure, the transistor quantity, and the aspect ratio of the transistor in the SR flip-flop 132-1 as required.

The first terminal (source terminal) of the second transistor M2 is used as the output terminal of the SR flip-flop 132-1 to be coupled to the corresponding scan line.

Figure 4A:
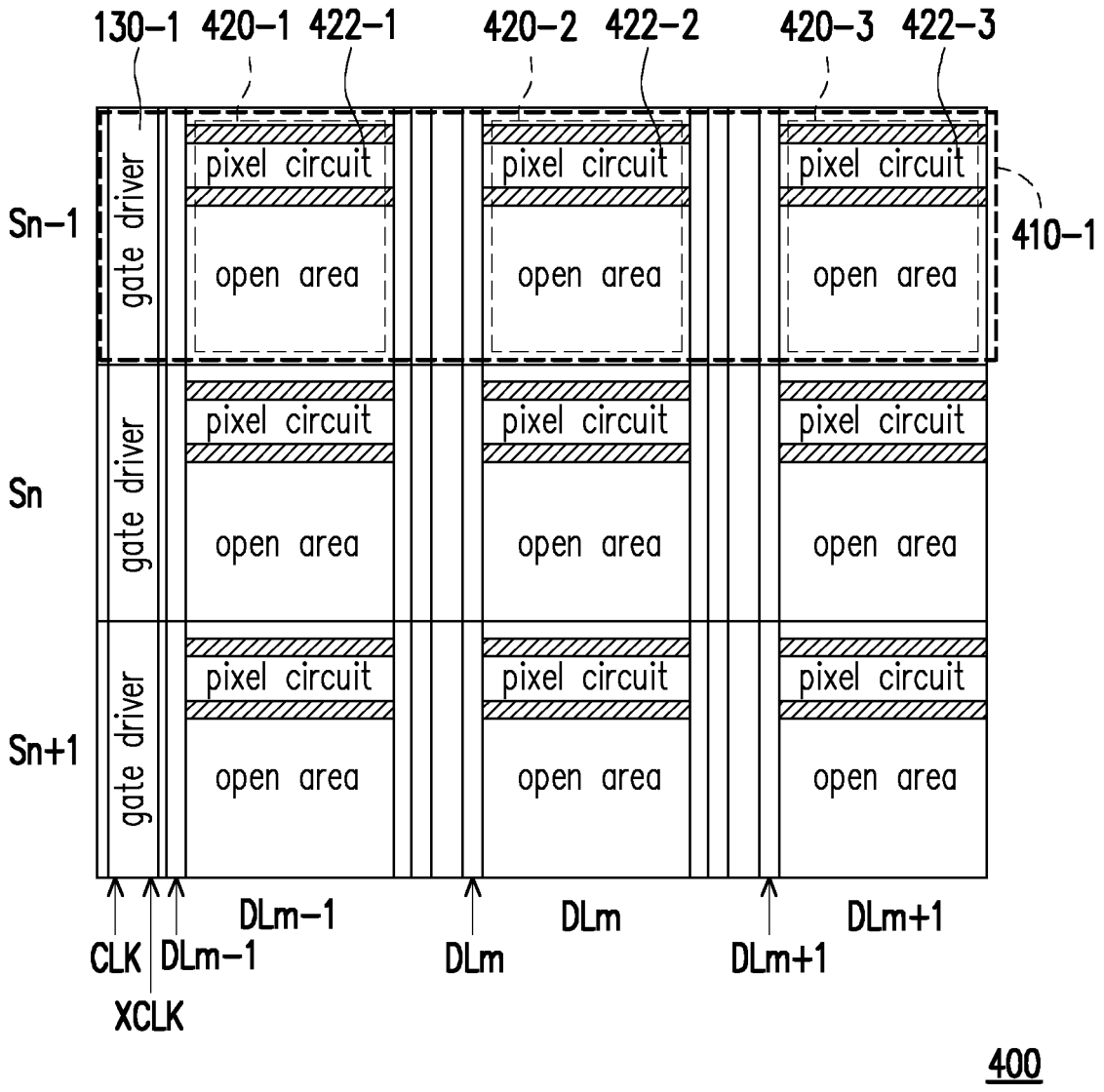
FIG. 4A is a schematic view of a pixel array with a gate driver according to a second embodiment of the disclosure.
Figure 4B:
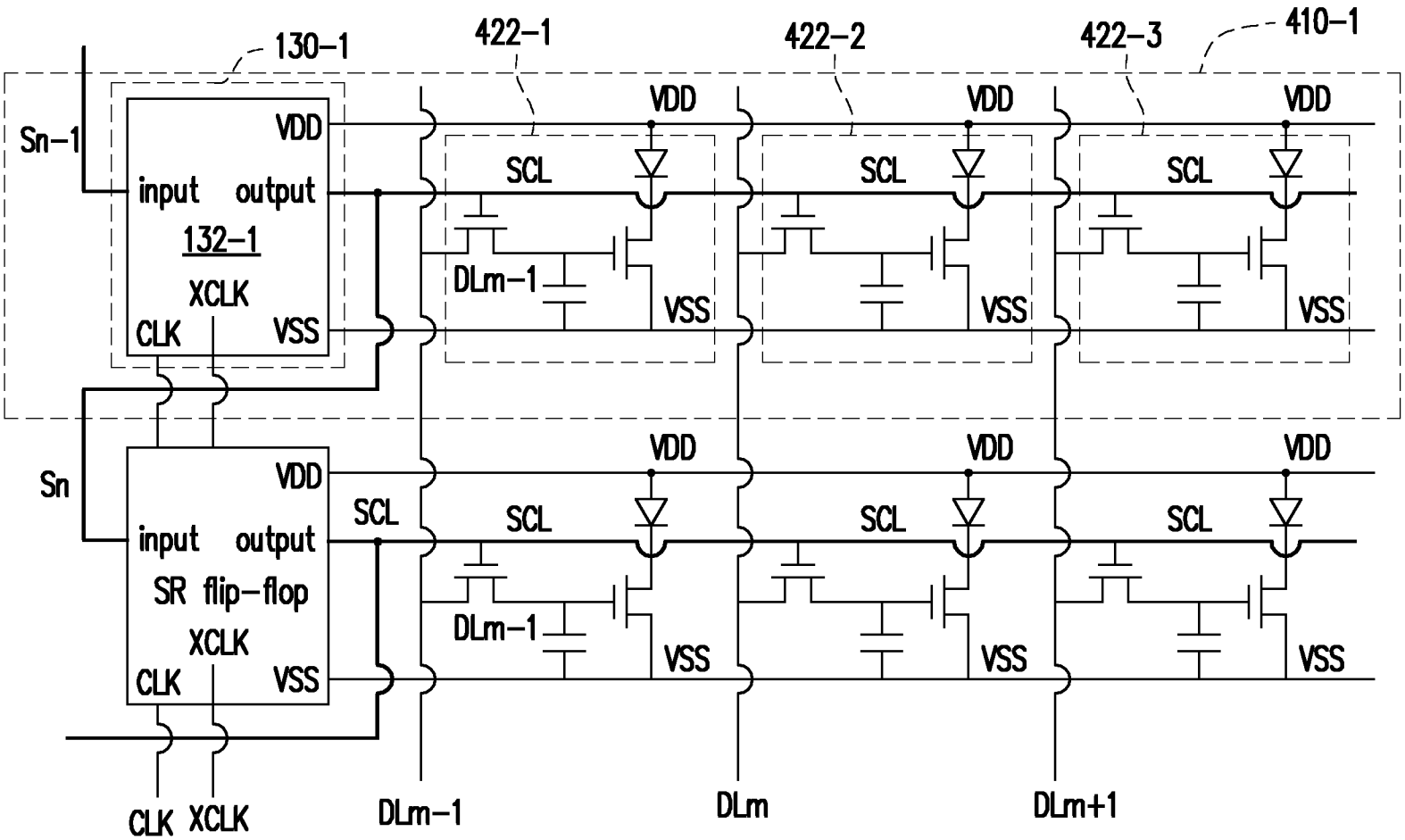
FIG. 4B is a circuit diagram of a pixel array module in FIG. 4A according to the second embodiment of the disclosure.

FIG. 4A is a schematic view of a pixel array 400 with a gate driver according to a second embodiment of the disclosure. FIG. 4B is a circuit diagram of a pixel array module 410-1 in FIG. 4A according to the second embodiment of the disclosure. Please refer to FIG. 4A and FIG. 4B at the same time. The pixel array 400 according to the second embodiment of the disclosure is exemplified using a pixel unit made up of three rows (represented by the gate control signals Sn−1, Sn, and Sn 1) and three columns (represented by the data lines DLm−1, DLm, and DLm+1). The pixel array 400 is a combination of units of pixel array module 410-1. Therefore, the pixel array module 410-1 is exemplified here. The pixel array module 410-1 includes three pixel units 420-1 to 420-3 and the gate driver 130-1. Each pixel unit 420-1 to 420-3 may be similar to the pixel unit 120-1 in FIG. 1. However, since the pixel unit 420-2 to 420-3 is not configured with a corresponding gate driver, the open area corresponding to the pixel unit 420-2 to 420-3 may be larger than the open area corresponding to the pixel unit 420-1.

On the other hand, when the quantity of the pixel units 420-1 to 420-3 in the pixel array module 410-1 is larger than or equal to two, the pixel units 420-2 to 420-3 of the embodiment are arranged in the horizontal direction/row direction relative to the pixel array 400. Persons applying the embodiment may adjust the quantity of the pixel units as required. For example, two or more (e.g., five) pixel units arranged in the horizontal direction/row direction and a single gate driver may be modularized to form a pixel array module. Also, the gate driver needs to be able to drive the pixel circuits in two or more pixel units. Persons applying the embodiment may adjust the quantity of the pixel units in the pixel array module until the gate driver allows the quantity of the pixel units in the pixel array module to reach the physical limit according to the operation load and frequency. In addition, in the case where the quantity of the pixel units 420-1 to 420-3 is two or more, the pixel units 420-1 to 420-3 may share a DC power supply terminal, for example, the ground voltage terminal VSS and the system voltage terminal VDD. As such, the circuit layout and routing of the pixel units 420-1 to 420-3 are more streamlined.

Each pixel unit 420-1 to 420-3 in the pixel array module 410-1 respectively includes a pixel circuit 422-1 to 422-3. Each pixel circuit 422-1 to 422-3 in the second embodiment may be implemented by the pixel circuit 122-1 in the first embodiment. The gate driver 130-1 includes the SR flip-flop 132-1 and the SR flip-flop 132-1 in FIG. 4B may be implemented by the circuit shown in FIG. 3. As such, the single gate driver 130-1 in the second embodiment may drive one or more pixel units (e.g., the pixel units 420-1 to 420-3 shown in FIG. 4A and FIG. 4B) at the same time, thereby improving the open ratio on the overall pixel unit relative to the open area and the light transmittance of the display.

Figure 5A:
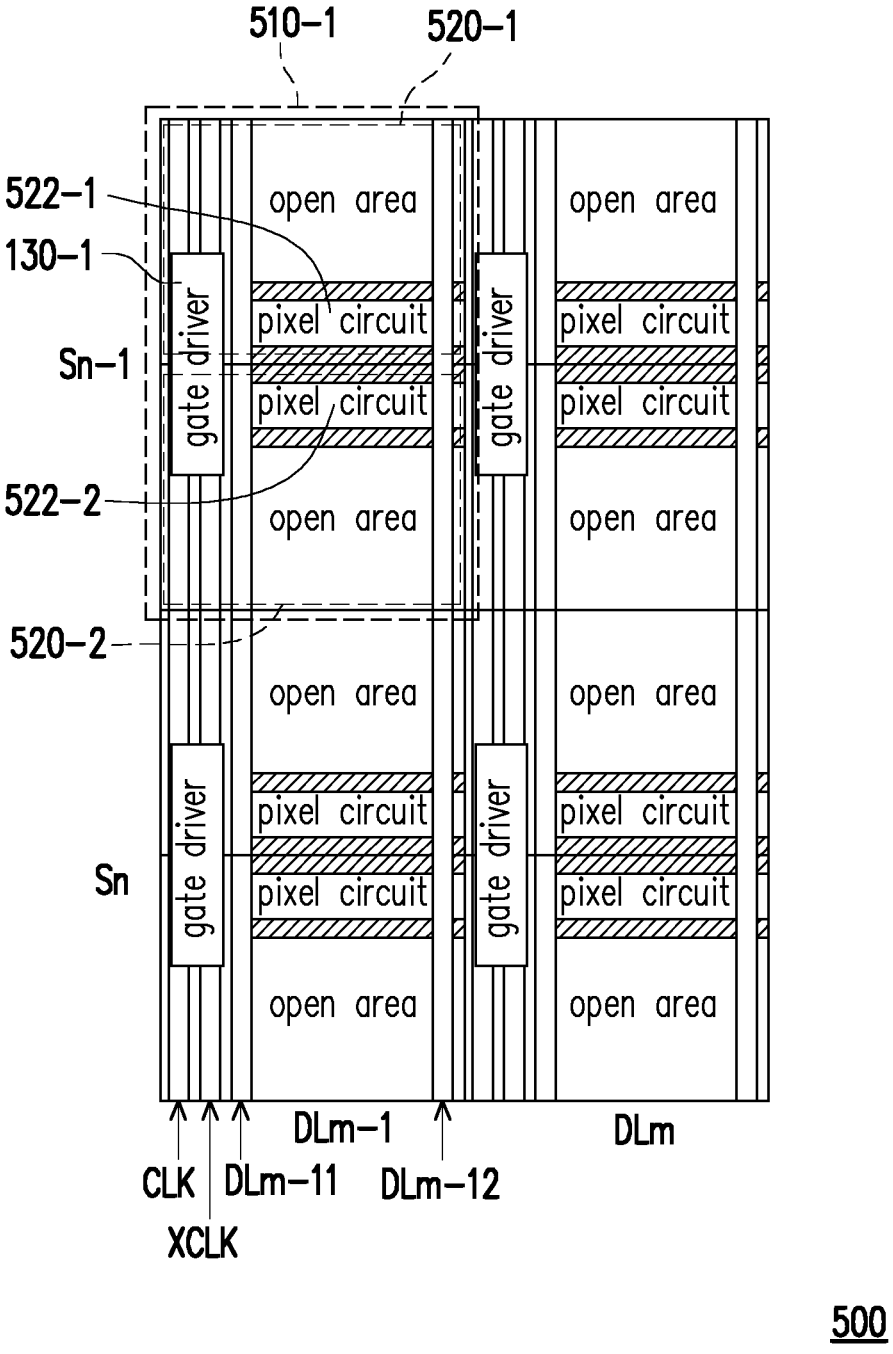
FIG. 5A is a schematic view of a pixel array with a gate driver according to a third embodiment of the disclosure.
Figure 5B:
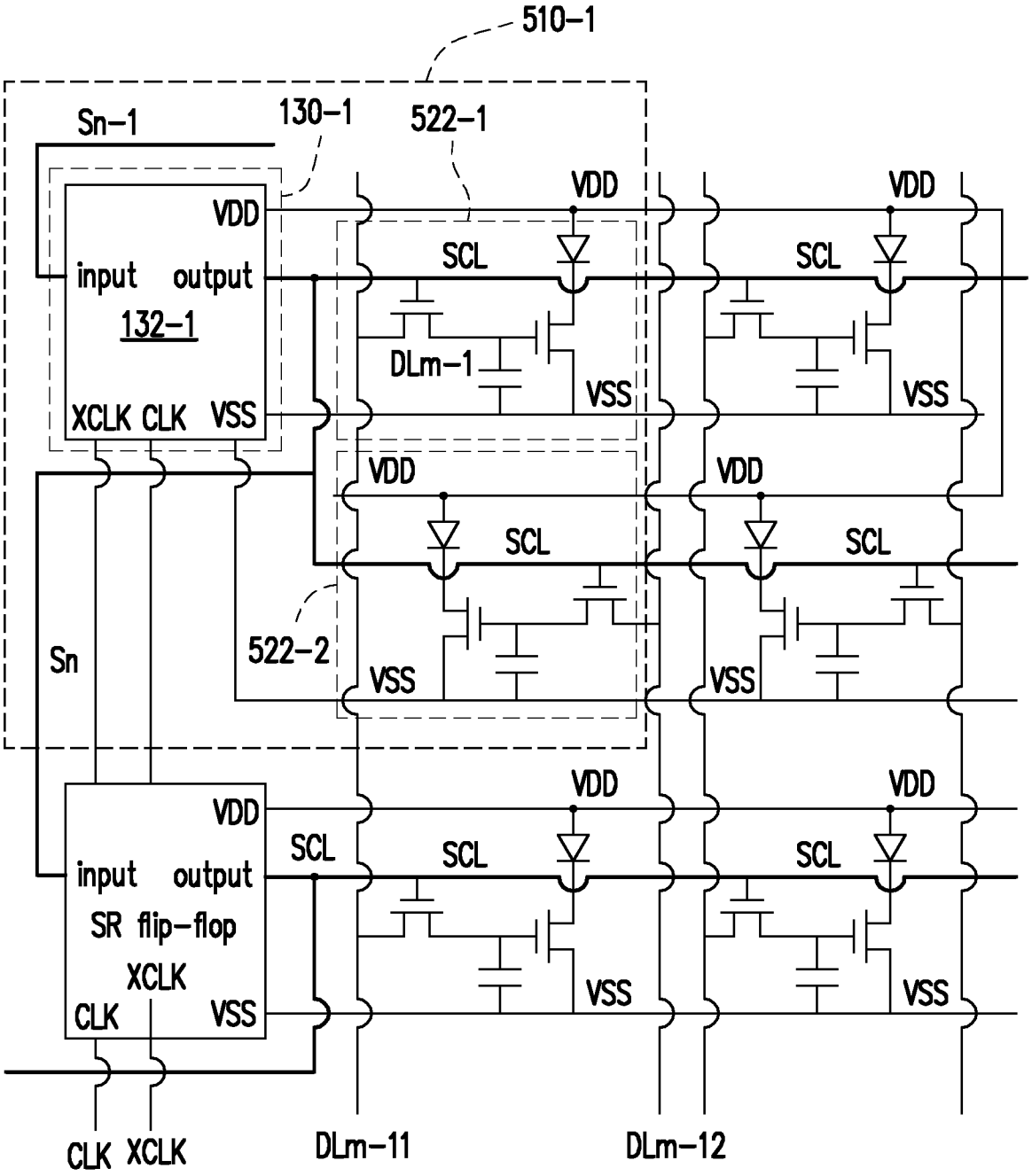
FIG. 5B is a circuit diagram of a pixel array module in FIG. 5A according to the third embodiment of the disclosure.

FIG. 5A is a schematic view of a pixel array 500 with a gate driver according to a third embodiment of the disclosure. FIG. 5B is a circuit diagram of a pixel array module 510-1 in FIG. 5A according to the third embodiment of the disclosure. Please refer to FIG. 5A and FIG. 5B at the same time. The pixel array 500 according to the third embodiment of the disclosure is exemplified using a pixel unit made up of four rows (represented by the gate control signals Sn−1 and Sn) and two columns (represented by the data lines DLm−1 and DLm).

Each scan line may drive two pixel units in the same column at the same time. For example, the gate control signal Sn−1 may drive the pixel units 520-1 to 520-2 in the same column at the same time. The pixel array 500 is a combination of units of the pixel array module 510-1. The pixel array module 510-1 includes two pixel units 520-1 to 520-2 and the gate driver 130-1. Each pixel unit 520-1 to 520-2 may be similar to the pixel unit 120-1 in FIG. 1. However, since a portion of the gate driver 130-1 is configured adjacent to the pixel unit 520-1 and another portion of the gate driver 130-1 is configured adjacent to the pixel unit 520-2, the open area corresponding to pixel units 520-1 and 520-2 may be larger than the open area corresponding to the pixel unit 120-1 in FIG. 1.

On the other hand, in the case where the quantity of the pixel units 520-1 to 520-2 in the pixel array module 510-1 is larger than or equal to two, the pixel unit 520-2 of the embodiment is arranged in the vertical/column direction relative to the pixel array 500. Persons applying the embodiment may adjust the quantity of the pixel units as required. For example, two pixel units arranged in the vertical/column direction and a single gate driver may be modularized to become a pixel array module and the gate driver needs to be able to drive the pixel circuits in the two pixel units. As such, one gate driver is shared by two vertical pixel units and the quantity of the data lines is two. If one gate driver is shared by three or more vertical pixel units, the data line needs to be increased to three or more. Persons applying the embodiment may adjust the quantity of the pixel units driven by the gate driver as required. Also, corresponding time sequence adjustment may be made in conjunction with the driving time sequence of the pixel unit until the layout space no longer has room for data lines.

Each pixel unit 520-1 to 520-2 in the pixel array module 510-1 respectively includes the pixel circuit 522-1 to 522-2. As such, the single gate driver 130-1 in the third embodiment may drive one or more pixel units (e.g., the pixel units 520-1 to 520-2 shown in FIG. 5A and FIG. 5B) at the same time, thereby improving the open ratio on the overall pixel unit relative to the open area and the light transmittance of the display.

Figure 6A:
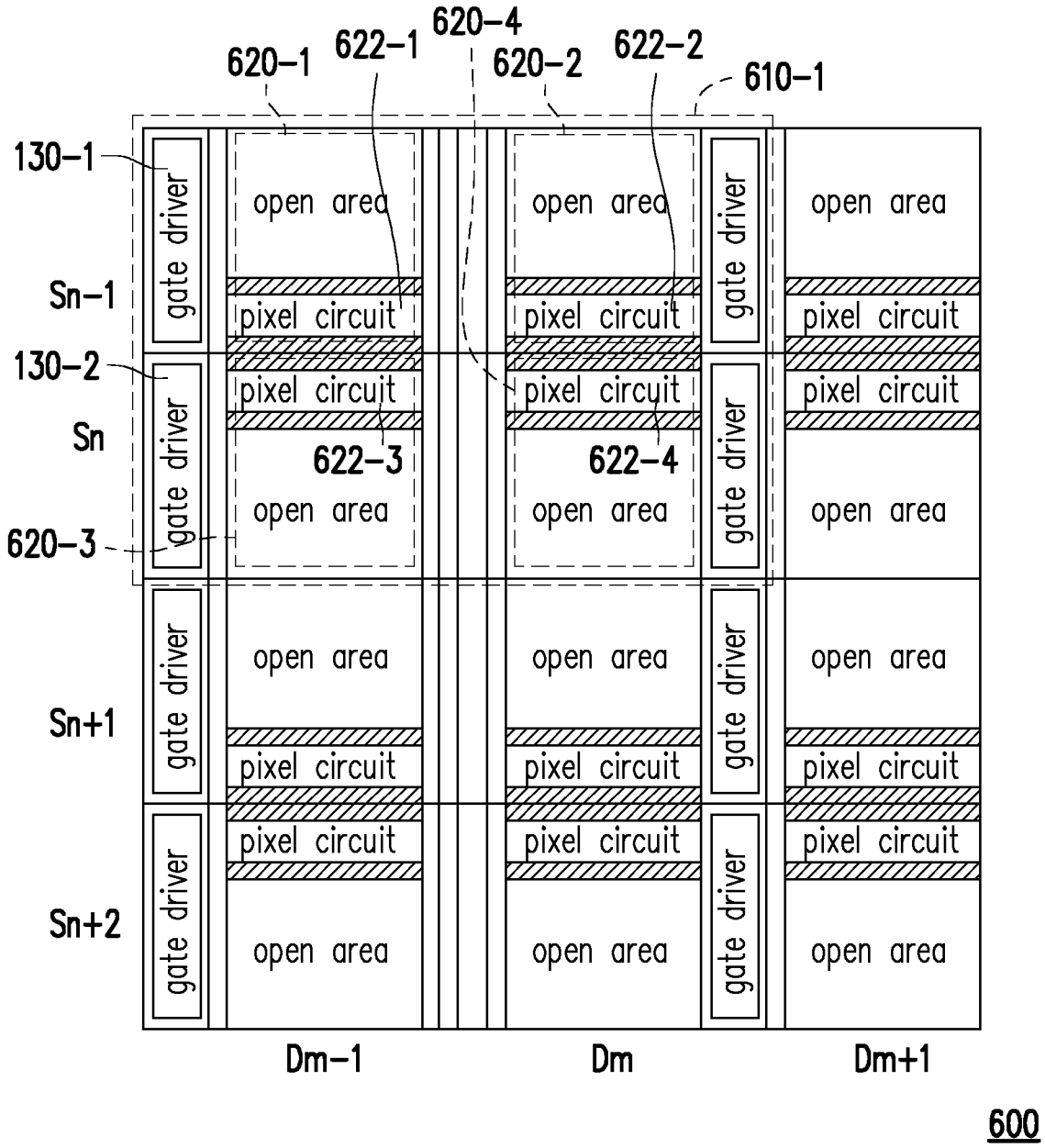
FIG. 6A is a schematic view of a pixel array with a gate driver according to a fourth embodiment of the disclosure.
Figure 6B:
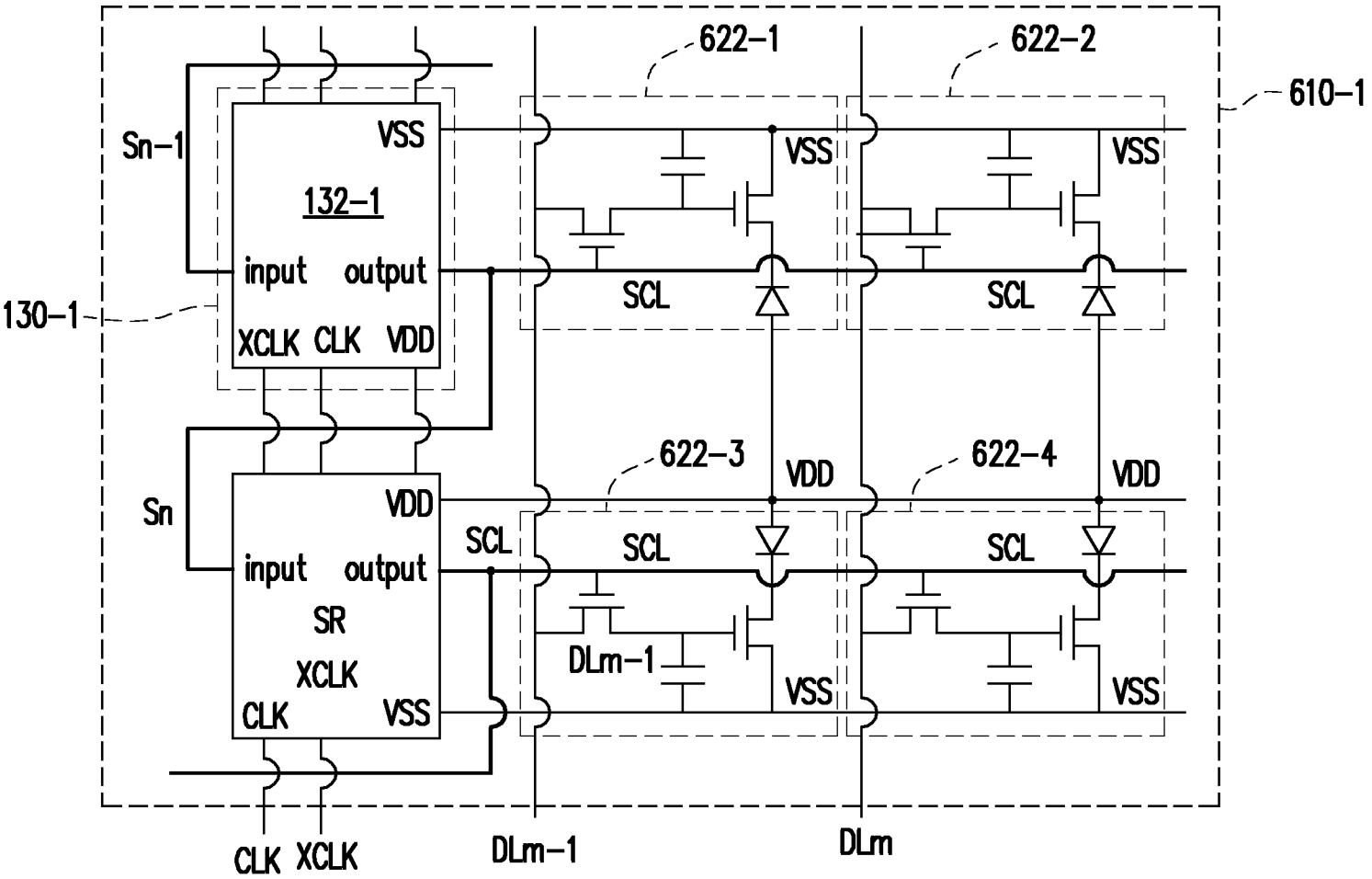
FIG. 6B is a circuit diagram of a pixel array module in FIG. 6A according to the fourth embodiment of the disclosure.

FIG. 6A is a schematic view of a pixel array 600 with a gate driver according to a fourth embodiment of the disclosure. FIG. 6B is a circuit diagram of a pixel array module 610-1 in FIG. 6A according to the fourth embodiment of the disclosure. Please refer to FIG. 6A and FIG. 6B at the same time. The pixel array 600 according to the fourth embodiment of the disclosure is exemplified using a pixel unit made up of four rows (represented by the gate control signals Sn−1, Sn, Sn+1, and Sn+2) and three columns (represented by the data lines DLm−1, DLm, and DLm+1). The pixel array 600 is a combination of units of the pixel array module 610-1. The pixel array module 610-1 includes four pixel units 620-1 to 620-4 and two gate drivers 130-1 and 130-2. Each pixel unit 620-1 to 620-4 may be similar to the pixel unit 120-1 in FIG. 1. However, since the gate driver 130-1 is configured adjacent to the pixel unit 620-1 and the gate driver 130-2 is configured adjacent to the pixel unit 620-3, the open area corresponding to the pixel unit 620-2 and 620-4 may be larger than the open area corresponding to the pixel unit 120-1 in FIG. 1.

Comparing the second embodiment with the fourth embodiment, the pixel array module 410-1 in FIG. 4A and FIG. 4B of the second embodiment does not share any line with other pixel array modules. However, the pixel array module 610-1 in FIG. 6A and FIG. 6B of the fourth embodiment is made up of two sets of pixel array modules 410-1 and the two sets of pixel array modules 410-1 share the system voltage terminal VDD. In other words, the gate drivers 130-1 and 130-2 in the fourth embodiment share the system voltage terminal VDD, the pixel circuits 622-1 and 622-2 in the pixel units 620-1 and 620-3 share the system voltage terminal VDD, and the pixel circuits 622-2 and 622-4 in the pixel units 620-2 and 620-4 share the system voltage terminal VDD. As such, the circuit layout and routing of the pixel units 620-1 to 620-4 may be streamlined.

Figure 7A:
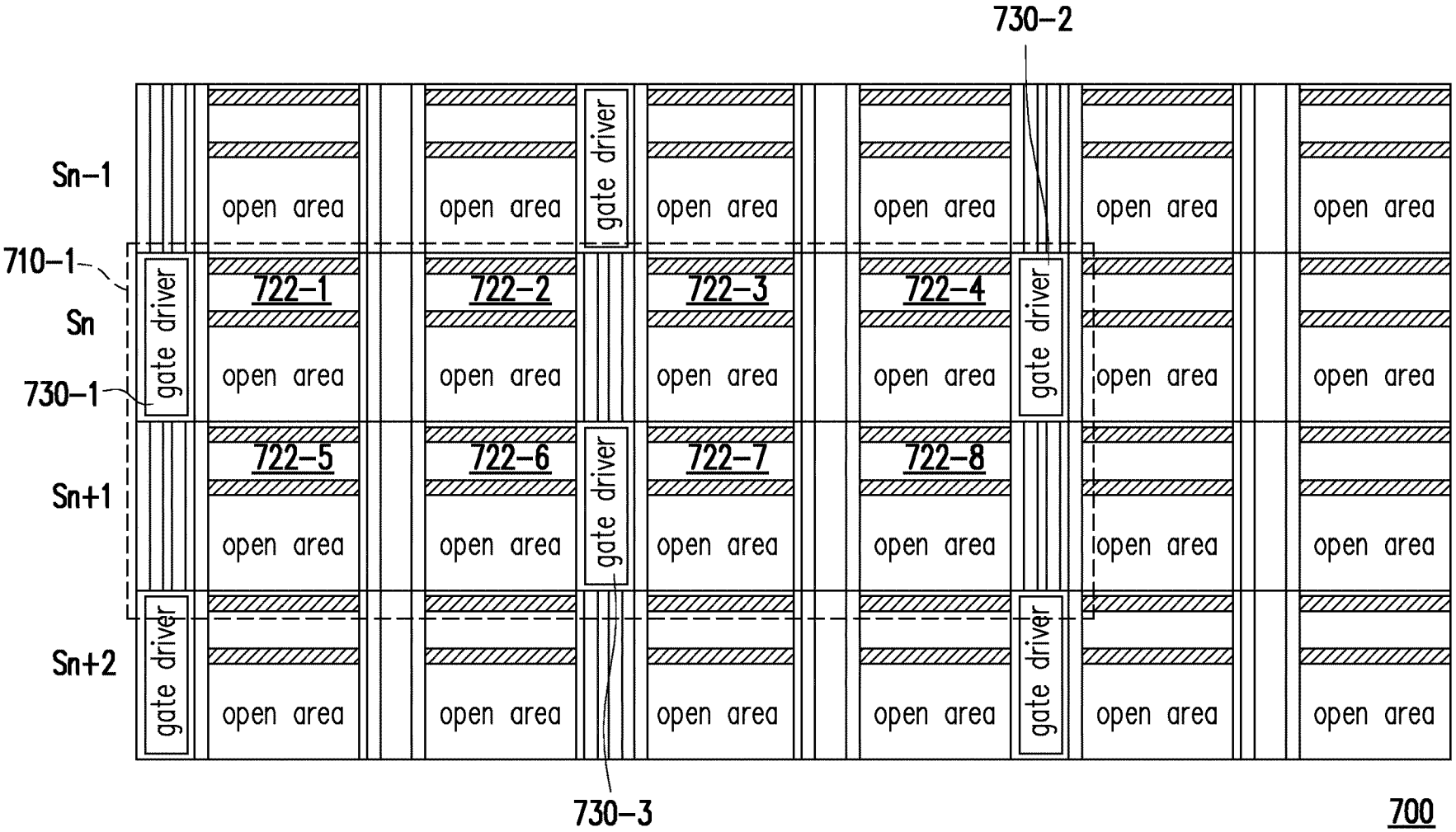
FIG. 7A is a schematic view of a pixel array with a gate driver according to a fifth embodiment of the disclosure.
Figure 7B:
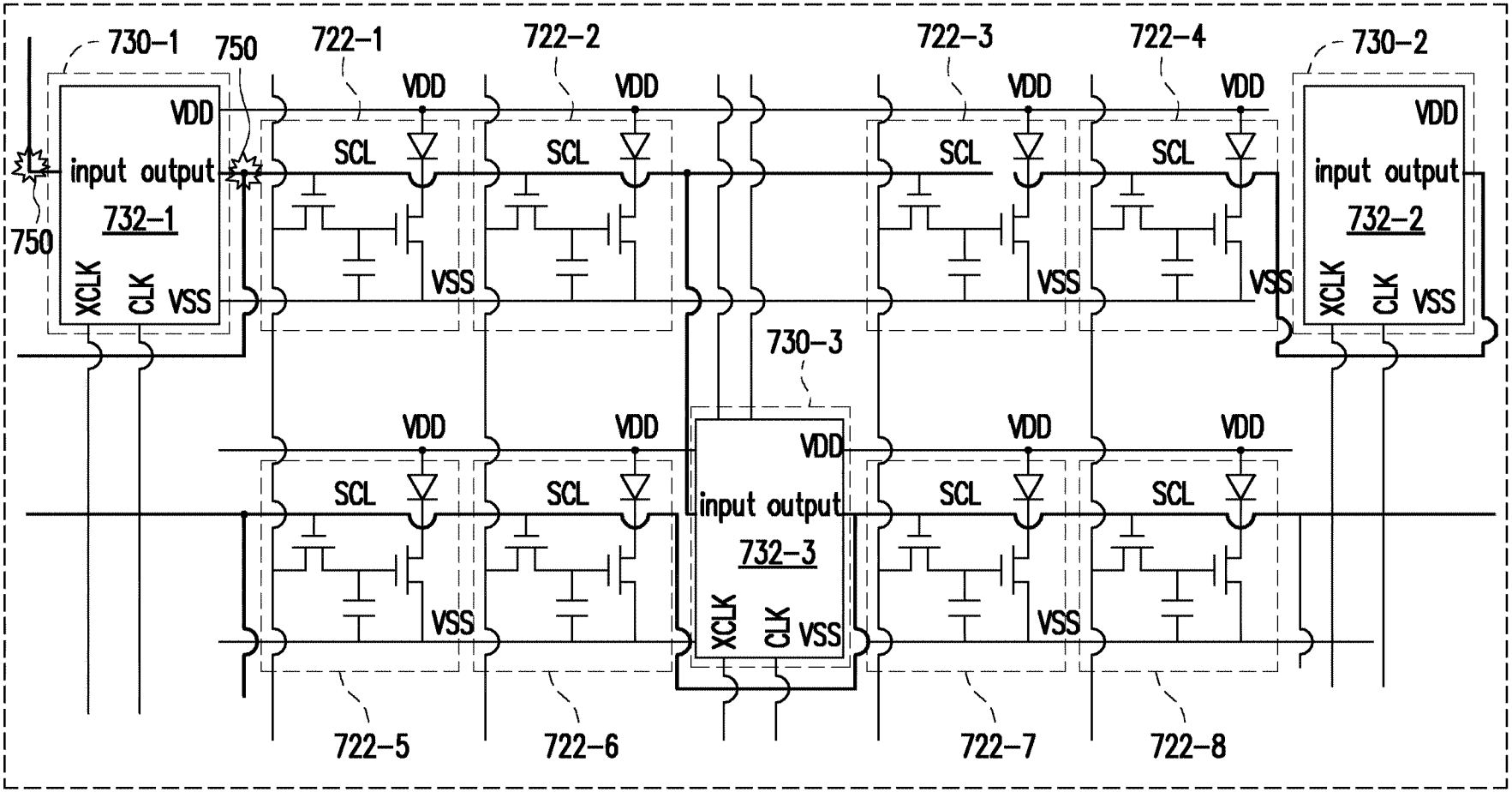
FIG. 7B is a circuit diagram of a pixel array module in FIG. 7A according to the fifth embodiment of the disclosure.

FIG. 7A is a schematic view of a pixel array 700 with a gate driver according to a fifth embodiment of the disclosure. FIG. 7B is a circuit diagram of a pixel array module 710-1 in FIG. 7A according to the fifth embodiment of the disclosure. Please refer to FIG. 7A and FIG. 7B at the same time. The pixel array 700 according to the third embodiment of the disclosure is exemplified using a pixel unit made up of four rows (represented by the gate control signals Sn−1 and Sn) and six columns. As can be known from FIG. 7A, in addition to the pixel units located in the second to third rows and the first to fourth columns, the pixel array module 710-1 also includes gate drivers 730-1, 730-2, and 730-3 disposed in the second row first column, the second row fifth column, and the third row first column. SR flip-flops 732-1, 732-2, and 732-3 in FIG. 7B are respectively the implementation circuits of the gate drivers 730-1, 730-2, and 730-3. It can be known from the configurational relationship of the gate drivers 730-1, 730-2, and 730-3 and the pixel circuits

722-1 to 722-8 of the pixel array module 710-1 in FIG. 7A and FIG. 7B that the output terminal output of the SR flip-flops 732-1 and 732-2 corresponding to the gate drivers 730-1 and 730-2 are coupled to each other to generate the gate control signal Sn and the gate control signal Sn is coupled to the gate terminal of the thin film transistor in the pixel circuits 722-1 to 722-4. The system voltage terminal VDD and the ground voltage terminal VSS of the SR flip-flops 732-1 and 732-2 and the pixel circuits 722-1 to 722-4 are coupled to each other. The gate driver 730-3 is the next-level gate driver of the gate drivers 730-1 and 730-2. The gate driver 730-3 is used to drive the pixel circuits 722-5 to 722-8. Also, one or more other back-up gate drivers may be included in the same row.

When one of the gate drivers 730-1 and 730-2 is damaged or the scan line Sn is broken and unable to transmit signals, the other one of the gate drivers 730-1 and 730-2 may be used as the backup gate driver to output the scan line Sn to the pixel circuits 722-1 to 722-4. Persons applying the embodiment may test whether each gate driver is damaged after manufacturing the display panel. If any gate driver is damaged, for example, the gate driver 730-1 is damaged, laser cutting technology may be used at two positions 750 in FIG. 7B to isolate the damaged gate driver 730-1. As such, after the display panel is manufactured, if a portion of the gate driver is damaged, the back-up gate driver and laser repair technology to burn off the corresponding line may be used to isolate the damaged gate driver, thereby making up for any error (e.g., lines which cannot be properly coupled) in the semiconductor process or the corresponding technology, which causes the gate driver to be erroneous, thereby improving the yield of the display panel without having to dispose the entire display panel.

In the above embodiment, in addition to the sequential output of scan lines using gate drivers connected in series to drive the pixel units in the corresponding row, the gate drivers of odd rows may also be designed to be connected in series and the gate drivers of even rows may also be designed to be connected in series, so that two types of time sequences may be used to drive the pixel units of the corresponding rows. Persons applying the embodiment may appropriately adjust various embodiments of the disclosure as required, so as to implement a frameless design of the display panel through a pixel array module combined of a miniaturized gate driver and pixel unit.

Figure 8A:
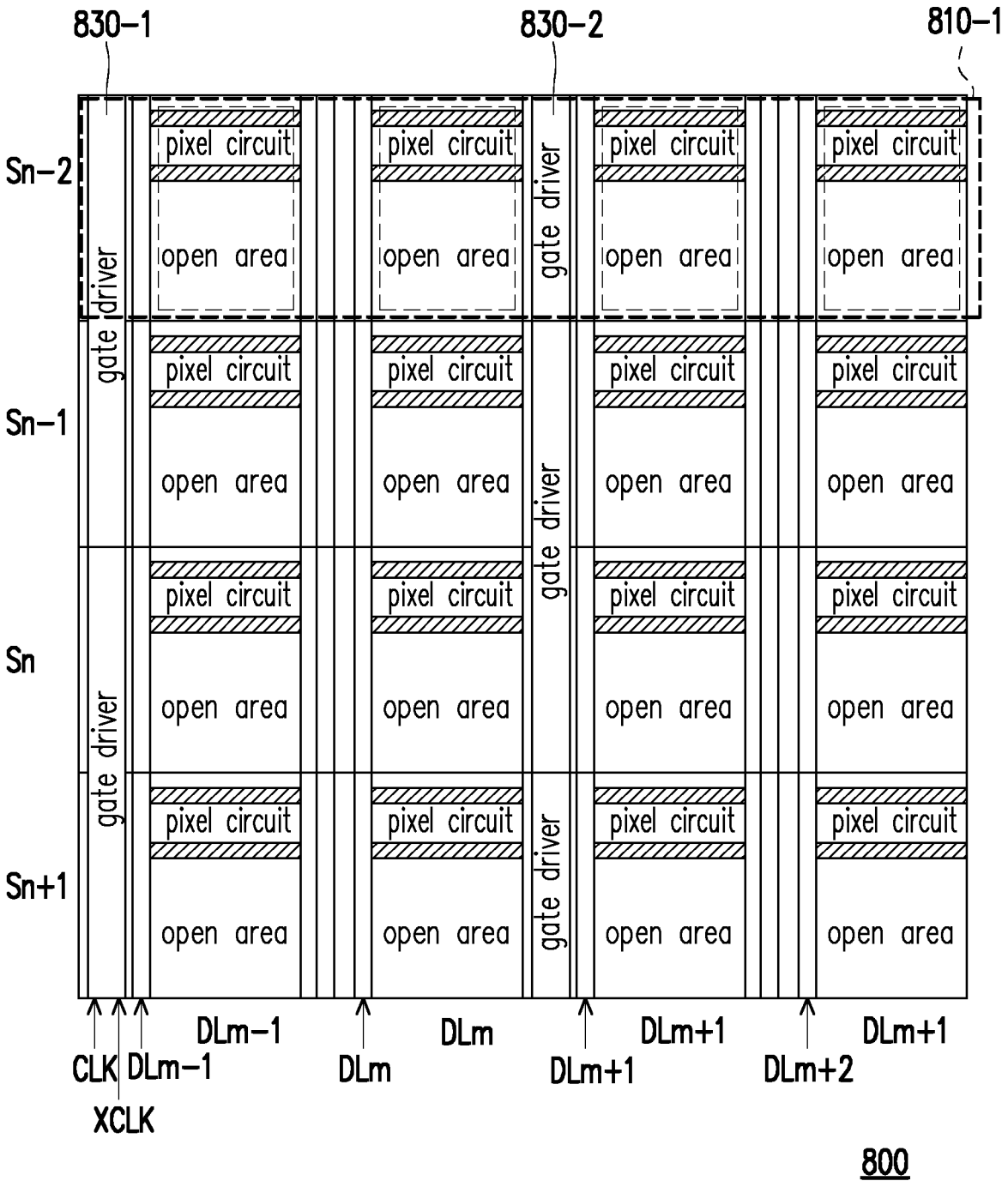
FIG. 8A is a schematic view of a pixel array with a gate driver according to a sixth embodiment of the disclosure.
Figure 8B:
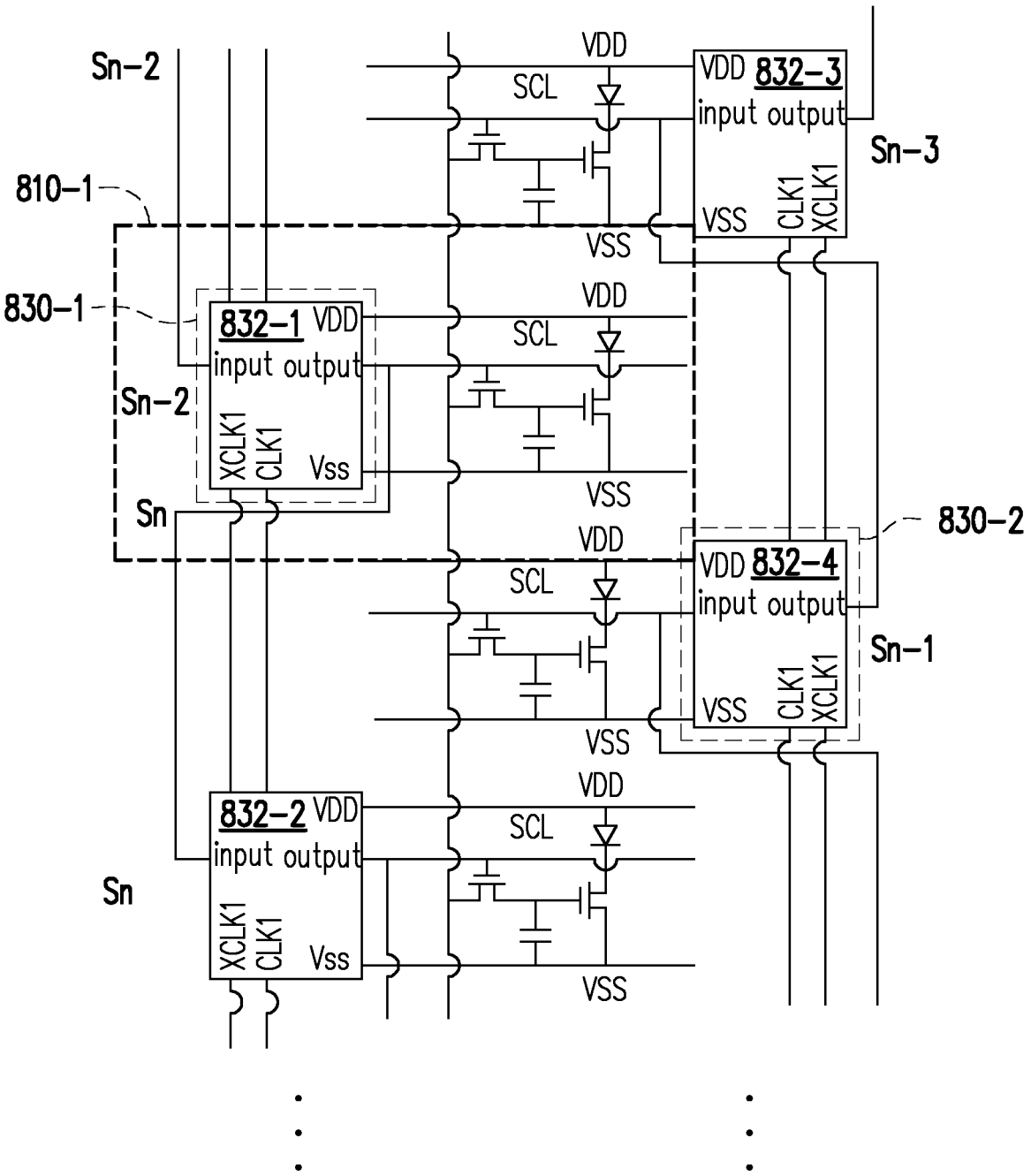
FIG. 8B is a circuit diagram of a pixel array module and an adjacent pixel array module in FIG. 8A according to the sixth embodiment of the disclosure.
Figure 8C:
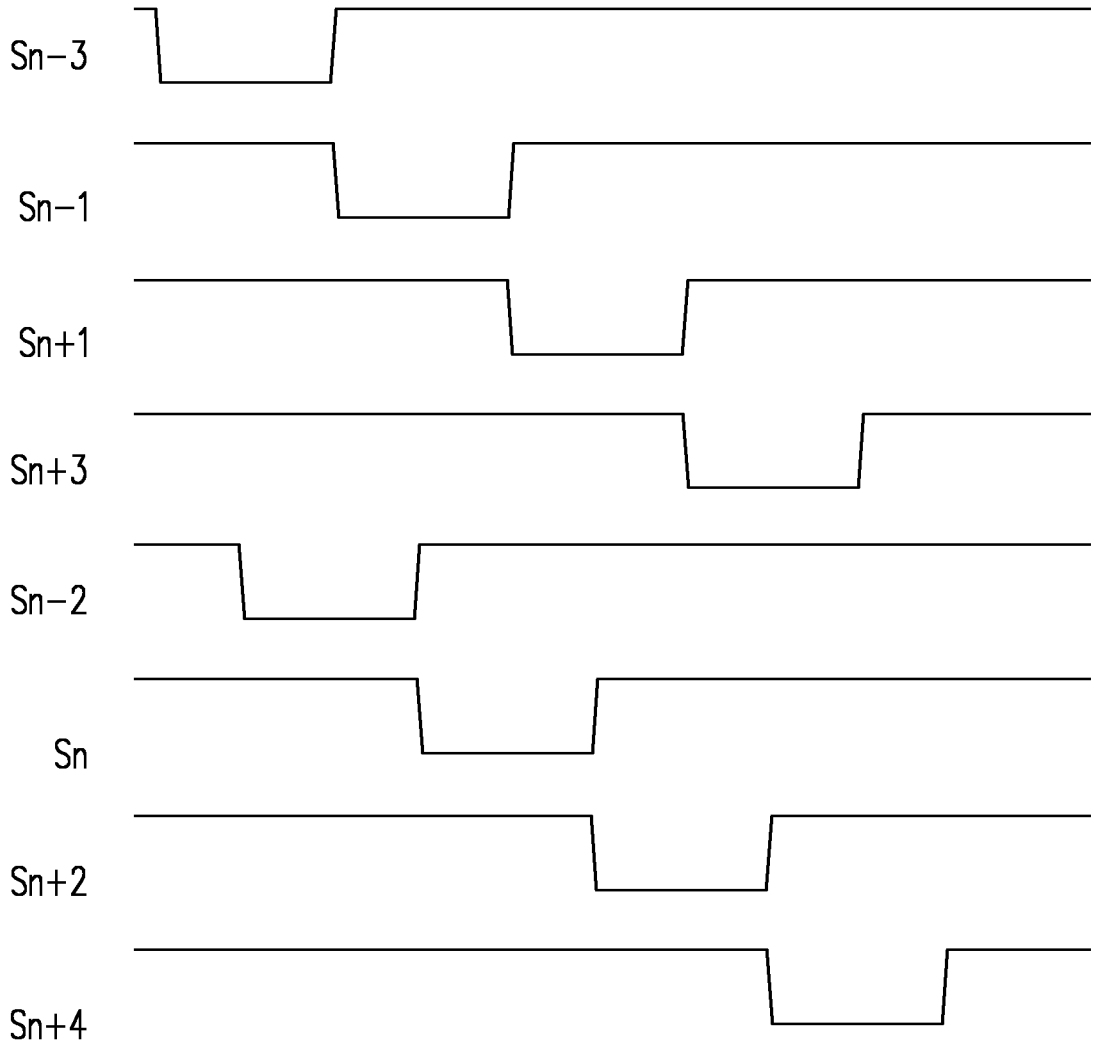
FIG. 8C is a waveform diagram of gate control signals in FIG. 8A and FIG. 8B.

FIG. 8A is a schematic view of a pixel array 800 with a gate driver according to a sixth embodiment of the disclosure. FIG. 8B is a circuit diagram of a pixel array module 810-1 and an adjacent pixel array module in FIG. 8A according to the sixth embodiment of the disclosure. FIG. 8C is a waveform diagram of gate control signals Sn−3 to Sn+4 in FIGS. 8A and 8B. Please refer to FIG. 8A to FIG. 8B at the same time. The pixel array 800 according to the sixth embodiment of the disclosure is exemplified using a pixel unit made up of four rows (represented by the gate control signals Sn−2, Sn−1, Sn, and Sn+1) and four columns. Overlapping scan technology may be used in the display panel of the embodiment, that is, the pixel array module 810-1 includes circuit elements located in the same or different pixel array modules and the gate drivers 830-1 and 830-2 in the pixel array module 810-1 may drive a plurality of (e.g., two) pixel units in the row direction. From another perspective, the embodiment regards the circuit elements corresponding to the gate control signals Sn−2 to Sn+1 on each row as each pixel array module, respectively. For example, the pixel array module 810-1 is the pixel array module 810-1 corresponding to the gate control signal Sn−2 on the row and the corresponding circuit elements on the row are also referred to as the pixel array module.

As shown in FIG. 8B, an SR flip-flop 832-1 as the gate driver 830-1 in the pixel array module 810-1 of the gate control signal Sn−2 on the row drives the SR flip-flop 832-2 in the next pixel array module 810-1 of the gate control signal Sn on the corresponding row in a manner separated by a row; the SR flip-flop 832-3 of the gate control signal Sn−3 on the corresponding row drives the next SR flip-flop 832-4 of the gate control signal Sn−1 on the corresponding row in a manner separated by a row.

FIG. 8C shows a time sequence diagram of a plurality of gate control signals Sn−3 to Sn+4. As can be known from FIG. 8C, the gate control signal Sn−3 of the embodiment is first enabled, and then the gate control signals Sn−1, Sn+1, and Sn+3 are sequentially enabled. On the other hand, the gate control signal Sn−2 of the embodiment is first enabled, and then the gate control signals Sn, Sn+2, and Sn+4 are sequentially enabled. In addition, the gate control signals Sn−3 and Sn−2 are respectively controlled by different gate drivers. The enabled periods of the gate control signals Sn−3 and Sn−2 may partially overlap. The enabled periods of the gate control signals Sn−1 and Sn may partially overlap. The enabled periods of the gate control signals Sn+1 and Sn+2 may partially overlap. In other words, the gate control signals of the embodiment may be divided into two groups, the first group is the gate control signals Sn−3, Sn−1, Sn+1, and Sn+3, and the other group is the gate control signals Sn−2, Sn, Sn+2, and Sn+4. The gate control signals in respective groups drive the next corresponding gate control signal in a manner separated by a row.

Figure 9A:
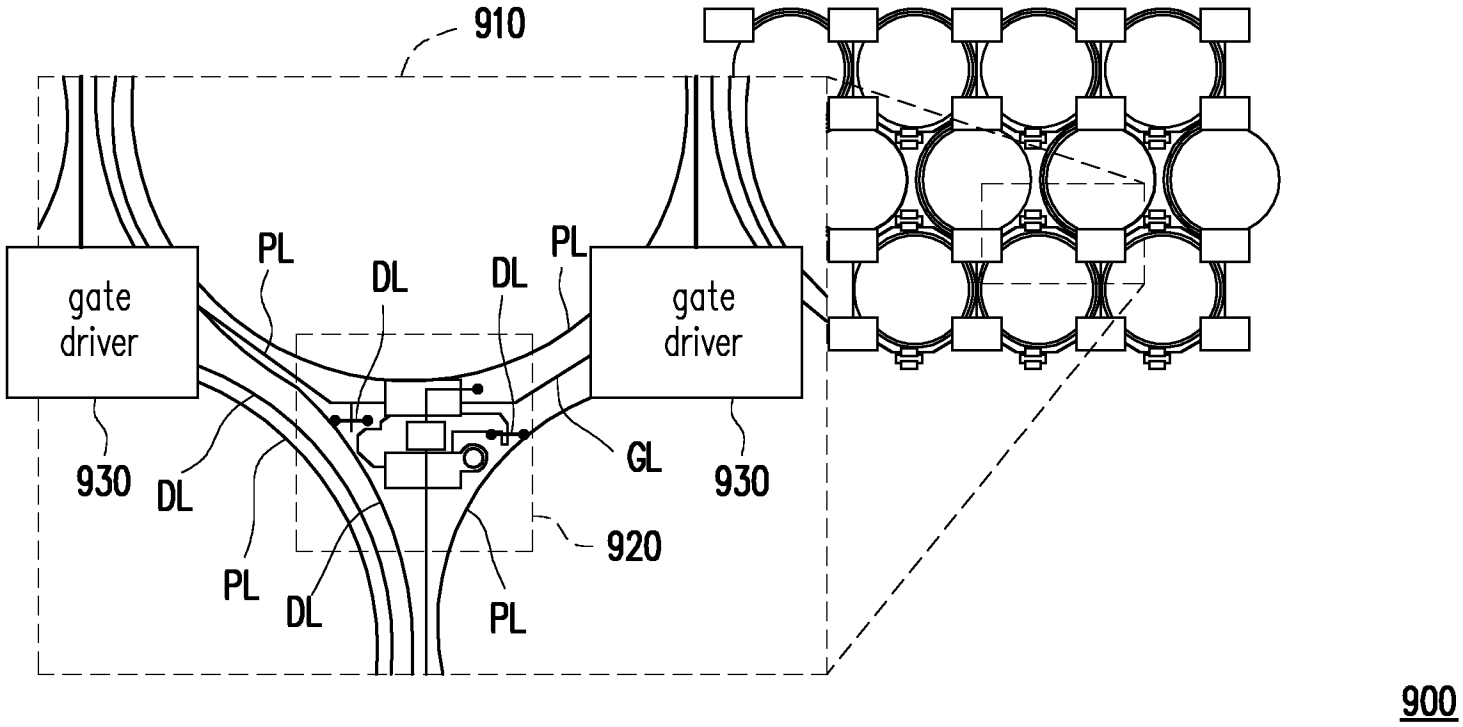
FIG. 9A illustrates a schematic view of a pixel unit and a pixel array module of a display panel with a circular arrangement as an example.
Figure 9B:
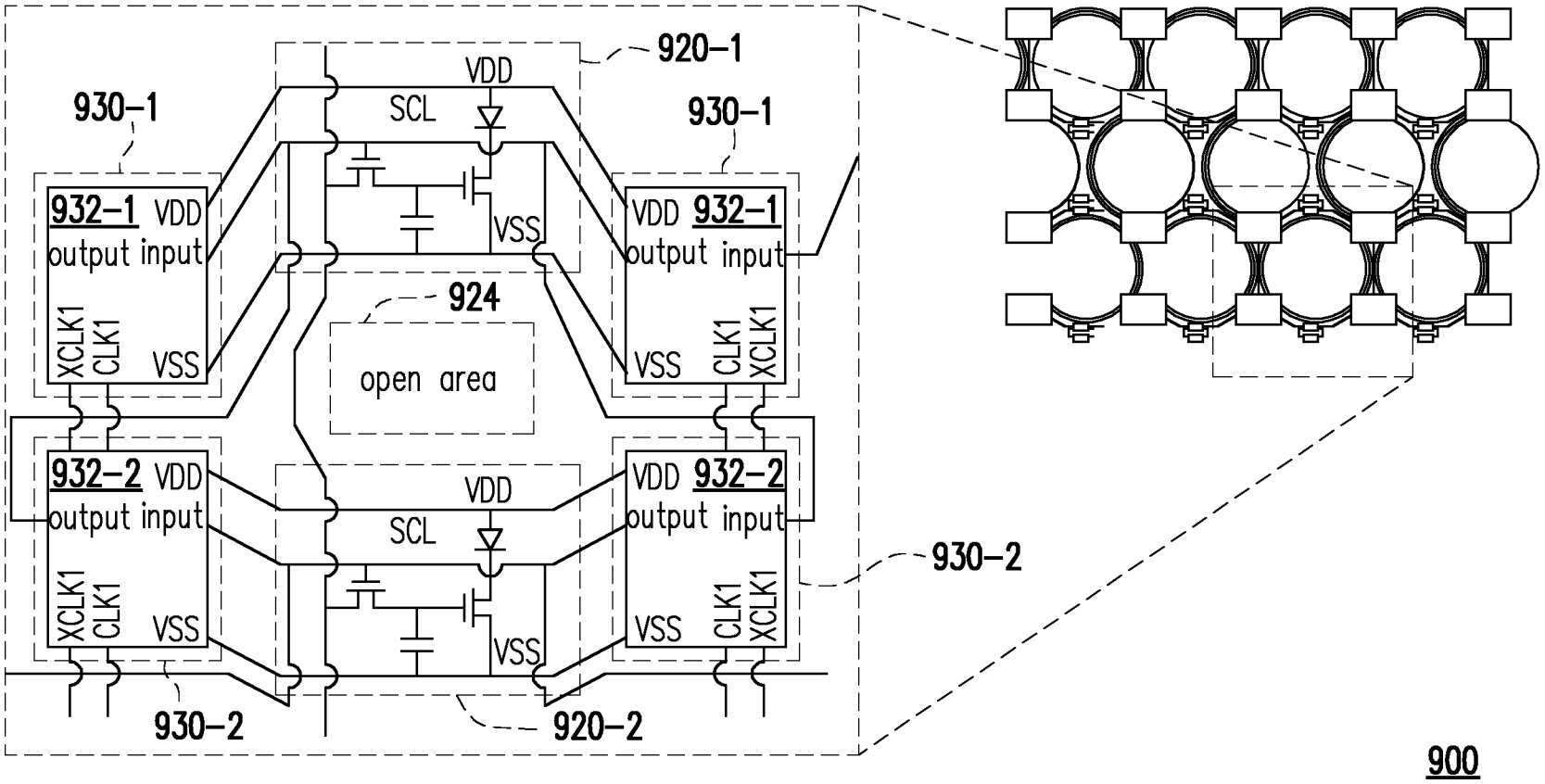
FIG. 9B illustrates a circuit diagram of a pixel unit and a pixel array module of a display panel with a circular arrangement as an example.

The pixel units in the above embodiments are arranged in a rectangular shape. The embodiments of the disclosure may also be applied to pixel units arranged in a non-rectangular shape (e.g., a circle, a hexagon, a trapezoid, etc.). FIG. 9A illustrates a schematic view of a pixel unit and a pixel array module 910 of a display panel 900 with a circular arrangement as an example. FIG. 9B illustrates a circuit diagram of a pixel unit and a pixel array module 910 of a display panel 9100 with a circular arrangement as an example. The pixel array module 910 in FIG. 9A may include, for example, a pixel unit 920 and two gate drivers 930 which may back up each other. The circuit layout shown in the pixel array module 910 of FIG. 9A is, for example, a data line DL located in the pixel unit 920, a power line PL in the gate driver 930 and the pixel unit 920 used to be coupled to the ground voltage terminal VSS and the system voltage terminal VDD, and a scan line GL. SR flip-flops 932-1 of the two gate drivers 930-1 in FIG. 9B are coupled to the pixel unit 920-1 to back up each other; SR flip-flops 932-2 of the two gate drivers 930-2 are coupled to the pixel unit 920-2 to back up each other. An open area 924 of FIG. 9B is surrounded by the gate drivers 930-1 and 930-2, and the pixel units 920-1 and 920-2. The pixel units 920 of FIG. 9A and FIG. 9B are arranged to form the display panel 900 in a circular shape. Persons applying the embodiment may appropriately arrange the corresponding circuit layout of each pixel unit in the pixel array module 910 as required, which is not limited to FIG. 9A and FIG. 9B.

In the embodiments of the disclosure, the pixel unit in FIG. 1 to FIG. 9B may also be replaced with a sensor used in a matrix sensor array, that is, the physical quantity conversion device may be replaced with different types of sensing elements, such as an electrothermal conversion device (e.g., a pixel heater) or other devices capable of converting mechanical force and power, such as a pressure sensor, so as to implement a matrix sensor array, which not only reduces the circuit layout area of the matrix sensor array, but also increases the sensor density per unit area.

According to the embodiments of the disclosure, the gate driver is miniaturized and embedded in the pixel array or the matrix sensor array, so that the frameless design of the display panel may be implemented and the circuit layout area of the matrix sensor array may be reduced. In addition, a single gate driver may also be designed to drive one or more of the above pixel units/sensors at the same time, thereby improving the open ratio on the overall pixel unit and the light transmittance of the display, and improving the sensor density per unit area. On the other hand, a plurality of gate drivers are used to drive the corresponding pixel units/sensors, so that when a certain gate driver is damaged or the corresponding scan line is disconnected and unable to transmit signals, the entire display panel/matrix sensor array may still operate smoothly. The pixel array module/matrix sensor array is integrated from the mutual configurational relationship of the gate driver and the pixel unit/sensor to meet the design requirements of the display panel/array sensor in the embodiments of the disclosure.

Although the disclosure has been disclosed in the above embodiments, the embodiments are not intended to limit the disclosure. It will be apparent to persons skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A pixel array with a gate driver, comprising at least one pixel array module, wherein each of the at least one pixel array module comprises:

at least one pixel unit, the at least one pixel unit comprising a pixel circuit and an open area, wherein the pixel circuit comprises:

a thin film transistor, comprising a gate terminal, a source terminal, and a drain terminal, wherein the source terminal is coupled to a corresponding one of a plurality of data lines; and a physical quantity conversion device, coupled to the drain terminal of the thin film transistor; and at least one gate driver, disposed in correspond to the at least one pixel unit, wherein a scan line outputted by the at least one gate driver is coupled to the gate terminal in a corresponding one of the at least one pixel unit, wherein the at least one gate driver is disposed adjacent to one of the at least one pixel unit, and the at least one gate driver is controlled by a gate control signal to drive the corresponding one of the at least one pixel unit, wherein a layout area of the at least one pixel array module comprises the pixel circuit disposed on the at least one pixel unit and all components of the at least one gate driver, and all components of the at least one gate drivers of the at least one pixel array module are disposed on one side of adjacent pixel circuit.

2. The pixel array according to claim 1, wherein a length of a layout range of the at least one gate driver is smaller than twice a length of a layout range in the at least one pixel unit, and a layout area of each of the plurality of transistors is smaller than a layout area of the at least one pixel unit.

3. The pixel array according to claim 1, wherein the at least one gate driver and the pixel circuit are routed by a transparent material.

4. The pixel array according to claim 1, wherein in a case where a quantity of the at least one pixel unit is larger than or equal to two, the at least one pixel unit shares a DC supply power terminal with each other.

5. The pixel array according to claim 1, wherein in a case where a quantity of the at least one pixel unit is larger than or equal to two, the at least one pixel unit is arranged in a horizontal direction relative to the pixel array.

6. The pixel array according to claim 1, wherein in a case where a quantity of the at least one pixel unit is larger than or equal to two, the at least one pixel unit is arranged in a vertical direction relative to the pixel array.

7. The pixel array according to claim 1, wherein in a case where a quantity of the at least one pixel unit is larger than or equal to two, the at least one pixel unit is arranged by N times M, where N and M are positive integers.

8. The pixel array according to claim 1, wherein at least one pixel unit in the pixel array is arranged in a rectangular shape.

9. The pixel array according to claim 1, wherein at least one pixel unit in the pixel array is arranged in a non-rectangular shape.

10. The pixel array according to claim 1, wherein the at least one gate driver comprises an SR flip-flop.

11. The pixel array according to claim 10, wherein the SR flip-flop comprises:

a first transistor, having a first terminal coupled to an input terminal of the SR flip-flop to receive the gate control signal, wherein a control terminal of the first transistor receives a backward clock signal;

a second transistor, having a control terminal coupled to a second terminal of the first transistor, wherein a second terminal of the second transistor receives a clock signal;

a third transistor, having a first terminal coupled to a system voltage terminal, wherein a second terminal of the third transistor is coupled to a first terminal of the second transistor;

a fourth transistor, having a control terminal is coupled to the second terminal of the first transistor, wherein a first terminal of the fourth transistor is coupled to the system voltage terminal;

a fifth transistor, having a control terminal is coupled to a control terminal of the third transistor and a second terminal of the fourth transistor, wherein a first terminal of the fifth transistor is coupled to the system voltage terminal and a second terminal of the fifth transistor is coupled to the second terminal of the first transistor and the control terminal of the second transistor; and a sixth transistor, having a control terminal and a second terminal coupled to a ground voltage terminal, wherein a first terminal of the sixth transistor is coupled to the second terminal of the fourth transistor, wherein the first terminal of the second transistor is used as an output terminal of the SR flip-flop to be coupled to a corresponding one of the scan line.

12. The pixel array according to claim 1, wherein in a case where a quantity of the at least one gate driver is larger than two, an output terminal of the at least one gate driver and a DC power supply terminal are coupled to each other.

13. An electronic device, comprising the pixel array with the gate driver according to claim 1.

14. A matrix sensor array with a gate driver, comprising at least one sensor array, wherein each of the at least one sensor array comprises:

at least one sensor, the at least one sensor comprising a sensing circuit and an open area, wherein the sensing circuit comprises:

a thin film transistor, comprising a gate terminal, a source terminal, and a drain terminal, wherein the source terminal is coupled to a corresponding one of a plurality of data lines; and a physical quantity conversion device, coupled to the drain terminal of the thin film transistor; and at least one gate driver, disposed in correspond to the at least one sensor, wherein a scan line outputted by the at least one gate driver is coupled to a gate terminal of a corresponding one of the at least one sensor, the at least one gate driver is disposed adjacent to one of the at least one sensor, and the at least one gate driver is controlled by a gate control signal to drive the corresponding one of the at least one sensor, wherein a layout area of the at least one sensor array comprises the sensing circuit disposed on the at least one sensor and all components of the at least one gate driver, and all components of the at least one gate drivers of the at least one sensor array are disposed on one side of adjacent sensor.

* * * * *